US011753818B1

(12) United States Patent
McKenna

(10) Patent No.: US 11,753,818 B1
(45) Date of Patent: Sep. 12, 2023

(54) ACOUSTIC MATERIAL FRAME AND METHOD

(71) Applicant: Kelly B. McKenna, New Richmond, WI (US)

(72) Inventor: Kelly B. McKenna, New Richmond, WI (US)

( * ) Notice: Subject to any disclaimer, the term of this patent is extended or adjusted under 35 U.S.C. 154(b) by 5 days.

(21) Appl. No.: 16/987,033

(22) Filed: Aug. 6, 2020

Related U.S. Application Data

(60) Provisional application No. 62/883,866, filed on Aug. 7, 2019.

(51) Int. Cl.

| | |
|---|---|
| ***E04B 1/86*** | (2006.01) |
| ***E04C 2/38*** | (2006.01) |
| *E04B 1/82* | (2006.01) |
| *E04B 1/84* | (2006.01) |

(52) U.S. Cl.
CPC ..... *E04B 1/86* (2013.01); *E04C 2/388* (2013.01); *E04B 2001/8263* (2013.01); *E04B 2001/8452* (2013.01)

(58) Field of Classification Search
CPC .... E04B 1/8209; E04B 1/8218; E04B 1/8404; E04B 1/8409; E04B 1/86; E04B 2001/8263; E04B 2001/8272; E04B 2001/8281; E04B 2001/8452; E04B 2/7412; E04B 1/1906; E04B 1/1903; E04B 1/1912; E04B 2001/1915; E04B 2001/1933; E04B 2001/1966; E04C 3/288
See application file for complete search history.

(56) References Cited

U.S. PATENT DOCUMENTS

| | | | | | |
|---|---|---|---|---|---|
| 1,995,819 | A * | 3/1935 | Rogers | E06B 7/30 | 109/21.5 |
| 3,483,947 | A * | 12/1969 | Sulewsky | E04B 1/86 | 181/290 |
| 4,016,689 | A * | 4/1977 | Wendt | E04B 1/6116 | 52/145 |
| 4,040,212 | A * | 8/1977 | Goransson | E04B 1/8218 | 52/145 |
| 4,271,654 | A * | 6/1981 | Jungbluth | E04B 1/5831 | 52/637 |
| 4,423,573 | A * | 1/1984 | Omholt | E04B 1/8227 | 52/145 |
| 4,574,099 | A * | 3/1986 | Nixon | B32B 27/12 | 428/68 |
| 4,574,538 | A * | 3/1986 | Grant | E04B 1/86 | 160/378 |
| 4,630,550 | A * | 12/1986 | Weitzman | A47B 13/06 | 108/155 |
| 4,702,046 | A * | 10/1987 | Haugen | E04B 1/10 | 181/286 |
| 4,706,422 | A * | 11/1987 | Ashton | E04B 2/7411 | 52/799.12 |
| 4,891,920 | A * | 1/1990 | Pingston | E04B 2/7409 | 181/287 |

(Continued)

*Primary Examiner* — Kyle J. Walraed-Sullivan
(74) *Attorney, Agent, or Firm* — R. John Bartz

(57) ABSTRACT

A thermoplastic frame for holding acoustical material has extruded square plastic tubing that is inserted or press-fit onto corner connectors and T-connectors to make an open ended enclosure that houses the acoustic material. Once the frame is assembled, the acoustic material is inserted in the open end of the frame.

10 Claims, 8 Drawing Sheets

(56) References Cited

U.S. PATENT DOCUMENTS 4,929,114 A * 5/1990 Young ..... E04B 1/5831 403/172
4,964,250 A * 10/1990 Nelson ..... E04B 1/86 52/144
4,989,688 A * 2/1991 Nelson ..... E04B 1/8227 181/286
5,020,632 A * 6/1991 Nelson ..... E04B 1/8227 181/290
5,079,890 A * 1/1992 Kubik ..... E04B 1/19 52/649.1
5,135,073 A * 8/1992 Nelson ..... E04B 1/8227 181/290
5,172,530 A * 12/1992 Fishel ..... A47B 21/06 160/135
5,220,765 A * 6/1993 Kubik ..... E04B 5/29 52/648.1
5,230,197 A * 7/1993 Hart ..... E04B 1/19 52/638
5,556,218 A * 9/1996 Homer ..... E04B 1/5831 403/170
6,158,176 A * 12/2000 Perdue ..... E04B 1/86 181/291
6,247,869 B1 * 6/2001 Lichvar ..... F16L 47/00 285/179.1
2004/0088941 A1 * 5/2004 Boots ..... A47B 47/027 52/655.1
2006/0124388 A1 * 6/2006 Pompei ..... E04B 1/86 181/290
2014/0233781 A1 * 8/2014 Kawakami ..... H04R 1/086 381/359
2015/0096832 A1 * 4/2015 Perez ..... E04B 1/86 181/292
2016/0222643 A1 * 8/2016 Castelli ..... E04B 1/34384
2017/0044753 A1 * 2/2017 Bowron ..... E04B 1/34326
2018/0075787 A1 * 3/2018 Frey ..... G09F 15/0018
2018/0238041 A1 * 8/2018 Styrc ..... E04B 1/1912
2018/0347200 A1 * 12/2018 Hooper ..... E01F 7/025
2019/0024364 A1 * 1/2019 Lestini ..... E04H 1/04
2019/0093343 A1 * 3/2019 Dimitrakopoulos ..... B32B 7/12
2019/0127972 A1 * 5/2019 Mackett ..... E04B 1/86
2019/0211557 A1 * 7/2019 Moghaddam ..... E04C 5/0627
2020/0270861 A1 * 8/2020 Bartella ..... E06B 3/9684
2021/0190278 A1 * 6/2021 Bartella ..... E04B 9/001
2021/0381223 A1 * 12/2021 Webb ..... E04B 1/34384

* cited by examiner

ACOUSTIC MATERIAL FRAME AND METHOD

CROSS REFERENCE TO RELATED APPLICATION

This application claims the priority of U.S. Application Ser. No. 62/883,866 filed Aug. 7, 2019.

FIELD OF THE INVENTION

The technology of the invention relates to an acoustic frame device, methods of manufacturing the device, and assembly, covering and methods of installation associated with the device.

BACKGROUND OF THE INVENTION

People that require acoustic treatment in their home or business need special material that absorbs sound, typically insulation such as fiberglass, mineral wool, open cell foam or other such types of material. Because these are raw materials and need to be framed and mounted or hung in a desired area and not behind walls, it requires users to either hire a company to custom build frames to enclose the raw material or purchase the frame materials and build the enclosures themselves. This may, depending on the user's skill level and available tools and time, take many hours with uncertain or inconsistent results.

Acoustically treating a space where people gather is challenging because commonly the acoustic materials are made mostly of compressed fiberglass insulation, mineral wool or other construction type materials. These materials need to be enclosed in a frame and covered by fabric for mounting on walls or ceilings in the desired area. Currently there is no simple, do-it-yourself (DIY) solution that does not require power tools, staple guns, tape measures, adhesives, basic construction skills, ample work space and lots of time. Currently there are no known quick and convenient (much less DIY) solutions to framing, covering and mounting acoustic material devices that control or absorb sound wave frequencies such as speech, noise, music, echo or other unwanted sounds. Most users are forced to contract with a company to build a frame to hold the acoustic material, which are expensive and many times creates a very heavy end product because the materials they use are typically either wood or metal. Acoustic frames currently being manufactured by companies use heavy materials such as wood, aluminum, steel or other metals. They require tools, time and labor to assemble the final product. Many times the frame is prohibitively heavy and requires multiple people and heavy-duty or industrial fasteners or anchors drilled into the target surface to install them. Current framing methods often cover the sides and the back of the frame, reducing air flow and therefore, sound absorption. Covering a large percentage of the sound absorption material greatly reduces the effectiveness and performance of the product. This method is also much more expensive. In seeking an alternative, the user is forced to build a frame themselves from traditional raw materials such as wood, aluminum or metal, and takes considerable time and skill. Building a frame usually includes using power tools such as skill saws, power drills, and staple guns. Some of these methods are beyond the scope of a typical user since they may not own power tools or even have access to an area to construct one such as a shop or a garage, e.g. apartments, town homes or condominiums. There are no convenient do-it-yourself (DIY) methods or kits on the market. The current alternatives fail to meet the needs of the industry because consumers want to purchase something that is convenient and easy to assemble that meets their needs. Existing attempts are similarly unable to meet the needs of the industry because they require at least some type of tools for assembly. These efforts also fail to meet the consumers' demand for a product that is DIY, yet is light weight, high performance, and can be put together quickly and easily without tools. No solution like that exists in the market today.

SUMMARY OF THE INVENTION

The acoustic material frame is a do-it-yourself plastic tube frame that encloses acoustic material. The frame is manufactured using strong but lightweight recycled and biodegradable extruded plastic tubing along with custom engineered corner and T-connectors to allow a person to assemble an acoustic frame themselves by press-fitting the tubing on the connectors within minutes without tools. The extruded plastic frame tubing is relatively thin to allow for maximum air flow to enhance acoustic absorption. The device also includes a custom-made fabric slipcover and simplistic mounting apparatus. The acoustic material frame is a unique DIY manufactured product made of plastic or thermoplastic, precisely measured and pre-cut and light weight and has specially designed custom connectors. The acoustic material frame is easy to assemble without the use of tools. The device can be press-fit together by taking the frame tubing and fitting the tubing onto the custom designed connector trunks to complete the frame. The frame is more effective and performs better than existing solutions because there is far less material and therefore allows more air flow and sound frequencies to pass into the frame to be absorbed. The acoustic material frame has a built-in mounting method for easy installation. The acoustic material frame and associated components are ecofriendly because they are constructed and manufactured using recycled and/or biodegradable plastics or thermoplastics. The acoustic frame has a custom fit, slip-cover that covers the frame and acoustic fabric to keep the insulation fibers from escaping into the air. The slipcover is available in multiple colors to match the user's decor. The acoustic material frame is also manufactured in such a way as to apply industry standard equipment such as thermoplastic injection molding, plastic extrusion, CNC milling, 3D printing or similar or related manufacturing equipment. Similarly, the disclosed method is unique when compared with other processes and solutions in that the components are manufactured to fit together and be mounted to the target surface by the user without using common household or power tools or assistance from others and truly a DIY product. The acoustic material frame is unique in that it is structurally different from other known devices or solutions. More specifically, the acoustic material frame is unique due to it being manufactured to fit together using a unique method of assembly using recycled, biodegradable thermoplastic extruded tubing and custom designed corner connectors and T-connectors that press-fit together to allow for easy assembly of the device without tools. Because of its manufactured design, the acoustic material frame is light weight, uses less plastic material and thin tubing, and is relatively porous to allow maximum amount of sound waves to flow into the frame and taken in by substantially all of the acoustic material, maximizing effectiveness. Further, the acoustic material frame is easily mounted to a targeted surface by a single person without use of common household tools. One of the most unique aspects of the device is the ease of assembly. It is designed to be assembled in a relatively short period of time using no tools. Speed, performance and ease of assembly of the device is unlike other crude, do-it-yourself assemblies requiring lumber, tools, hardware, workspace and time.

DESCRIPTION OF THE INVENTION

In the following detailed descriptions of the acoustic material frame assembly, reference is made to the accompanying drawing that form a part hereof, and in which are shown, by way of illustration, specific embodiments in which the invention may be practiced. It is to be understood that other embodiments may be utilized and structure changes may be made or other method steps and sequence thereof may be used without departing from the scope of the present invention. The acoustic material frame assembly is herein described as used in home and business environments. The frame assembly can have uses in other environments when sound absorption is desired.

Figure 1:
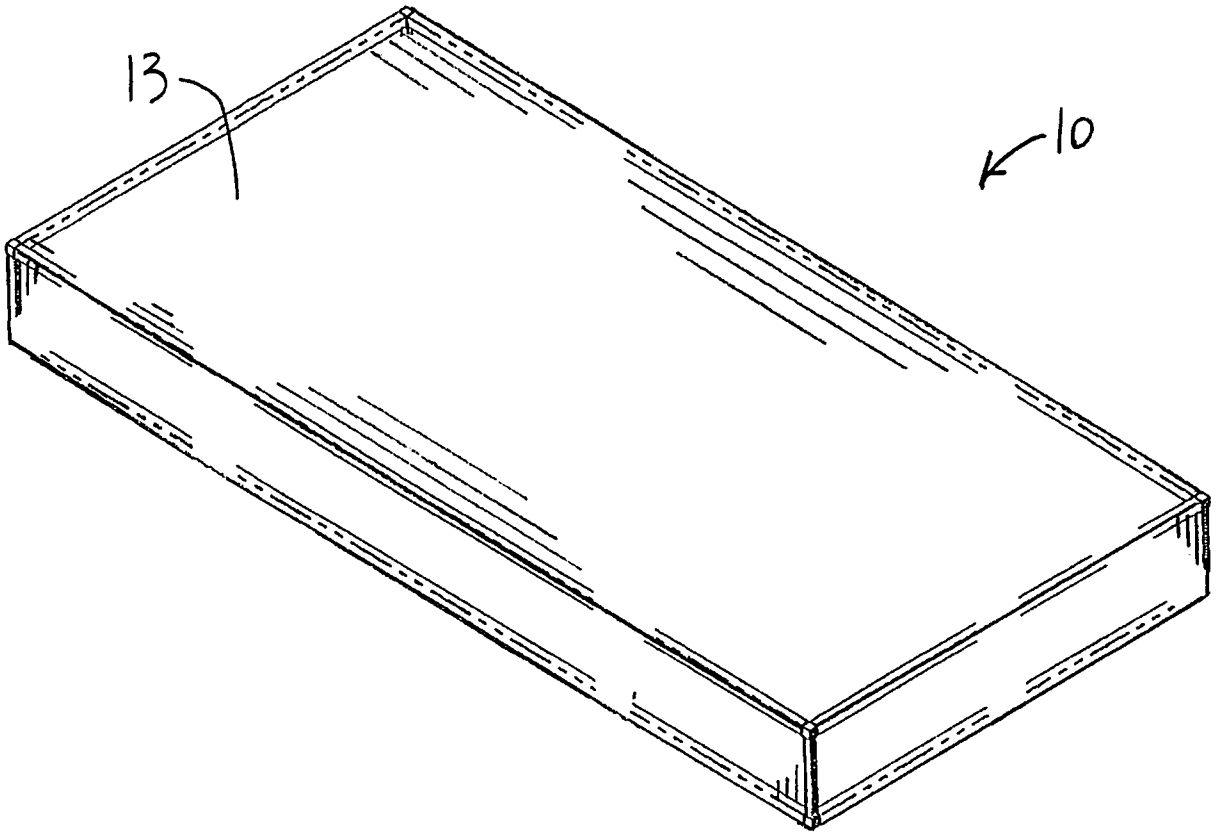
FIG. 1 is a perspective view of the acoustic material frame assembly of the invention.
Figure 2:
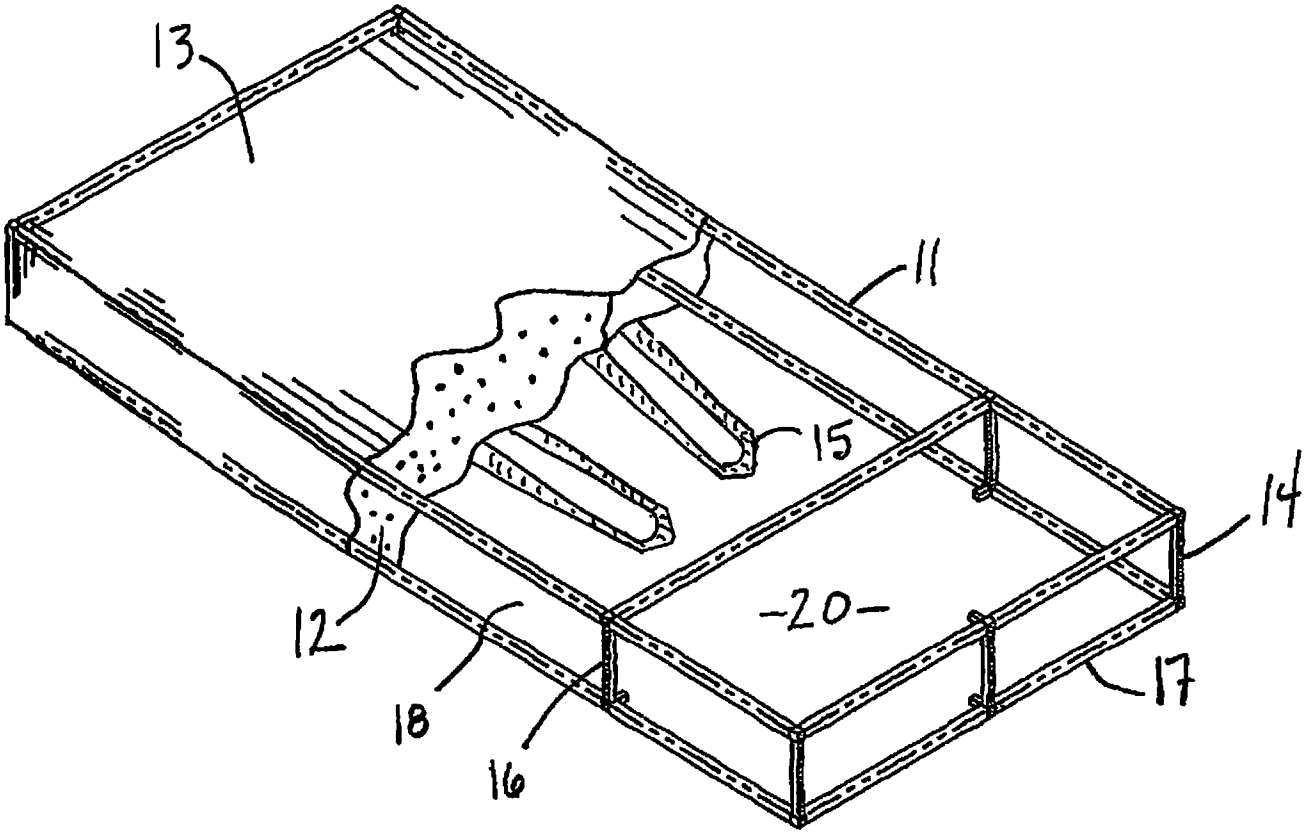
FIG. 2 is a foreshortened perspective view of the acoustic material frame assembly of FIG. 1.
Figure 3:
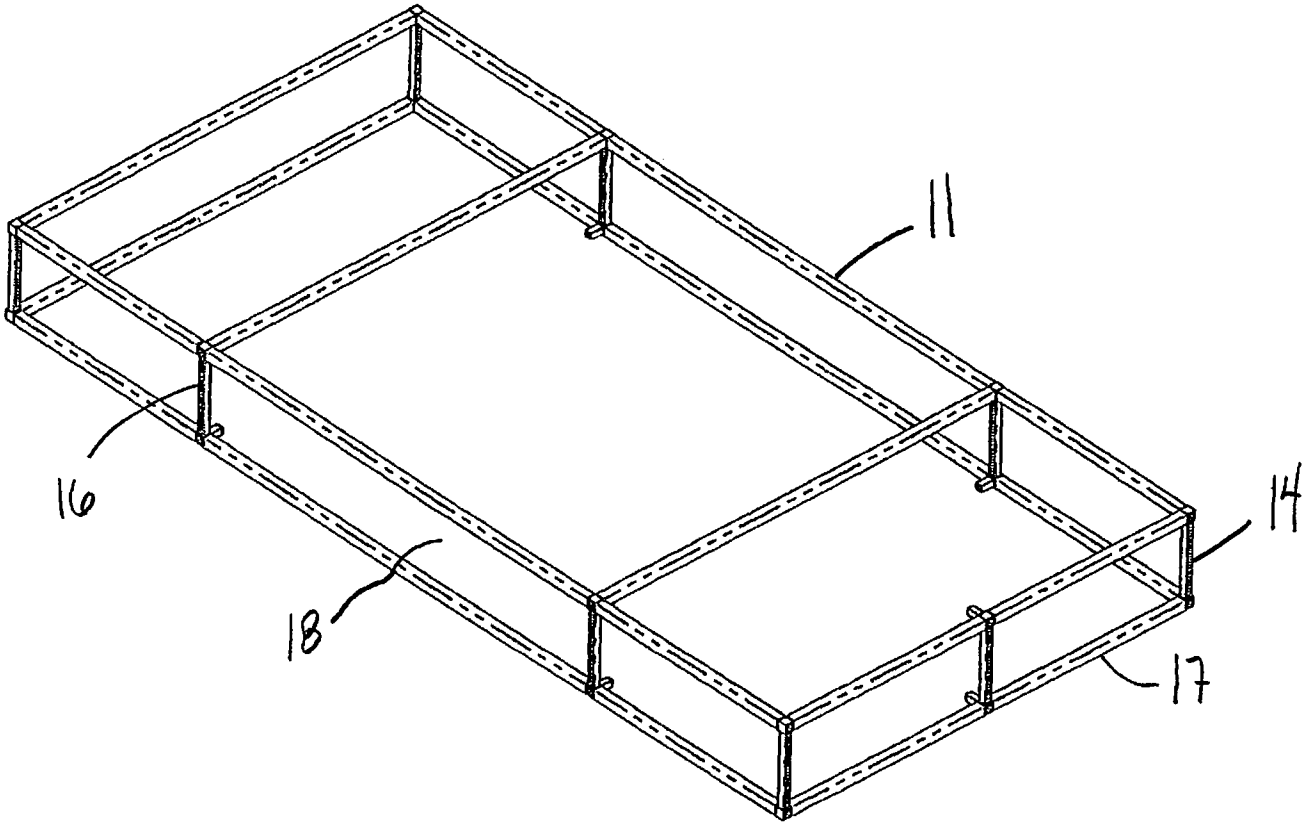
FIG. 3 is a perspective view of the frame of the acoustic material frame assembly of FIG. 1.

Referring to FIGS. 1 to 3, there is shown an acoustic material frame assembly indicated generally at 10. Frame assembly 10 is a do-it-yourself press-fit assembly having a plastic tube frame 11 that encloses acoustic material 12. Frame 11 can be assembled very quickly without the need for power tools, saws, staple guns, tape measures, nails, screws, staples, glue, adhesive compounds or other construction materials. Frame 11 houses, holds or otherwise encloses acoustic material 12 and when covered with fabric slipcover 13 or other similar material, can be placed in an area where sound absorption is needed and used to control echo, standing waves, slap-back or other problematic sound waves from any source. Frame 11 is manufactured using a biodegradable thermoplastic material such as polylactic acid (PLA), but can also be manufactured using other plastics or thermoplastics. Frame 11 can be manufactured in such a way as to apply industry standard equipment such as plastic injection molding, plastic extrusion, computer numerically controlled (CNC) milling, or additive manufacturing (AM) such as three dimensional (3D) printing or other related manufacturing equipment.

Figure 6:
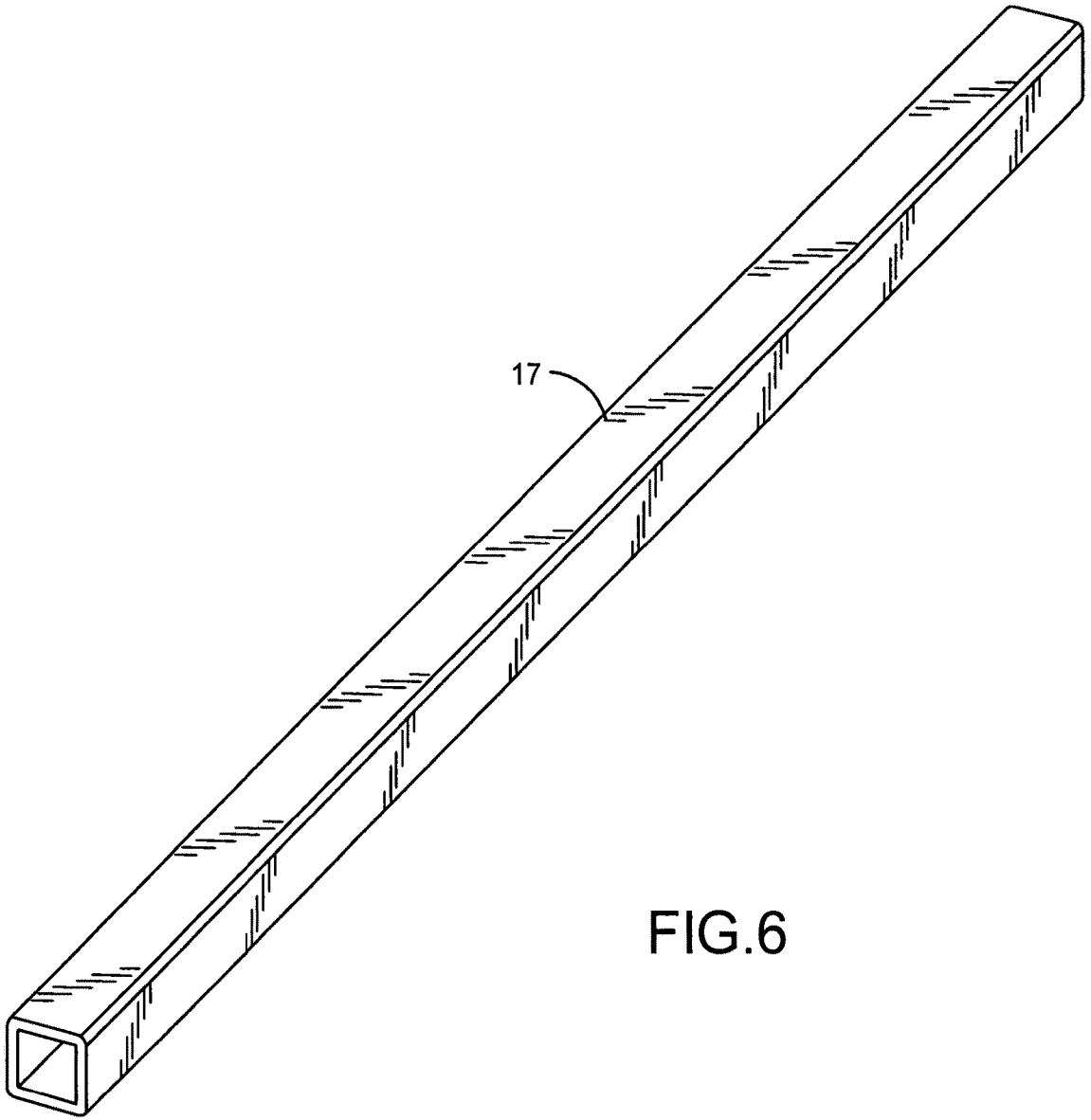
FIG. 6 is an enlarged perspective view of the frame tubing of the acoustic material frame assembly of FIG. 1.

Frame 11 has four-way corner connectors 14 and six-way T-connectors 16 that are four inches in depth, thereby allowing tubing 17 to be coupled by press-fitting or other methods onto corner connectors 14 and T-connectors 16 to assemble frame 11 to have a depth of four inches. Tubing 17 is a plurality of separate tubes of extruded square shape plastic, as seen in FIG. 6, cut to precise lengths which are connected together with four-way corner connectors 14 and six-way T-connectors 16. Tubing 17 can have a number of shapes such as round, rectangle, triangle and other multi-sided designs. Once assembled, frame 11 creates a frame structure having an open end 18 that allows the user to easily insert acoustic material 12 or other material into the interior 20 of frame 11.

Frame 11 can be made to have the shape of a square, rectangle, box, triangle or other shape desired by the user. T-connectors 16 are adapted to accommodate, but not limited to, four-inch thick acoustic material, depending on the type of sound waves to be absorbed, such as either high and midrange or low frequencies.

Once frame 11 is assembled, it is covered with fabric slipcover 13. Fabric slipcover 13 is preferably an acoustically transparent fabric custom sewn slipcover conducive to penetrable sound waves. Fabric slipcover 13 can have a variety of colors and designs for decorative purposes and to match the user's decor. Fabric slipcover 13 also prevents insulation particles from acoustic material 12 from escaping into the air. Fabric slipcover 13 is held tight and secured in the back of frame 11 by a fastener 15, such as a drawstring, Velcro fasteners or other hook and loop fasteners, snaps, ties, hooks, zippers, magnets or other fastening methods. Slipcover 13 easily fully covers the front, back and sides of the four inch deep frame 11 once the device is assembled. Slipcover 13 is made of acoustically sensitive fabric that allows sound waves to penetrate into acoustic material 12, while at the same time preventing particles from acoustic material 12 from escaping into the surrounding environment. The bottom of slipcover 13 can have a securing flap (not shown) that is attachable to slipcover 13 with Velcro fasteners, other hook and loop fasteners, draw-string ties, zippers, snaps, magnets and the like.

Figure 7:
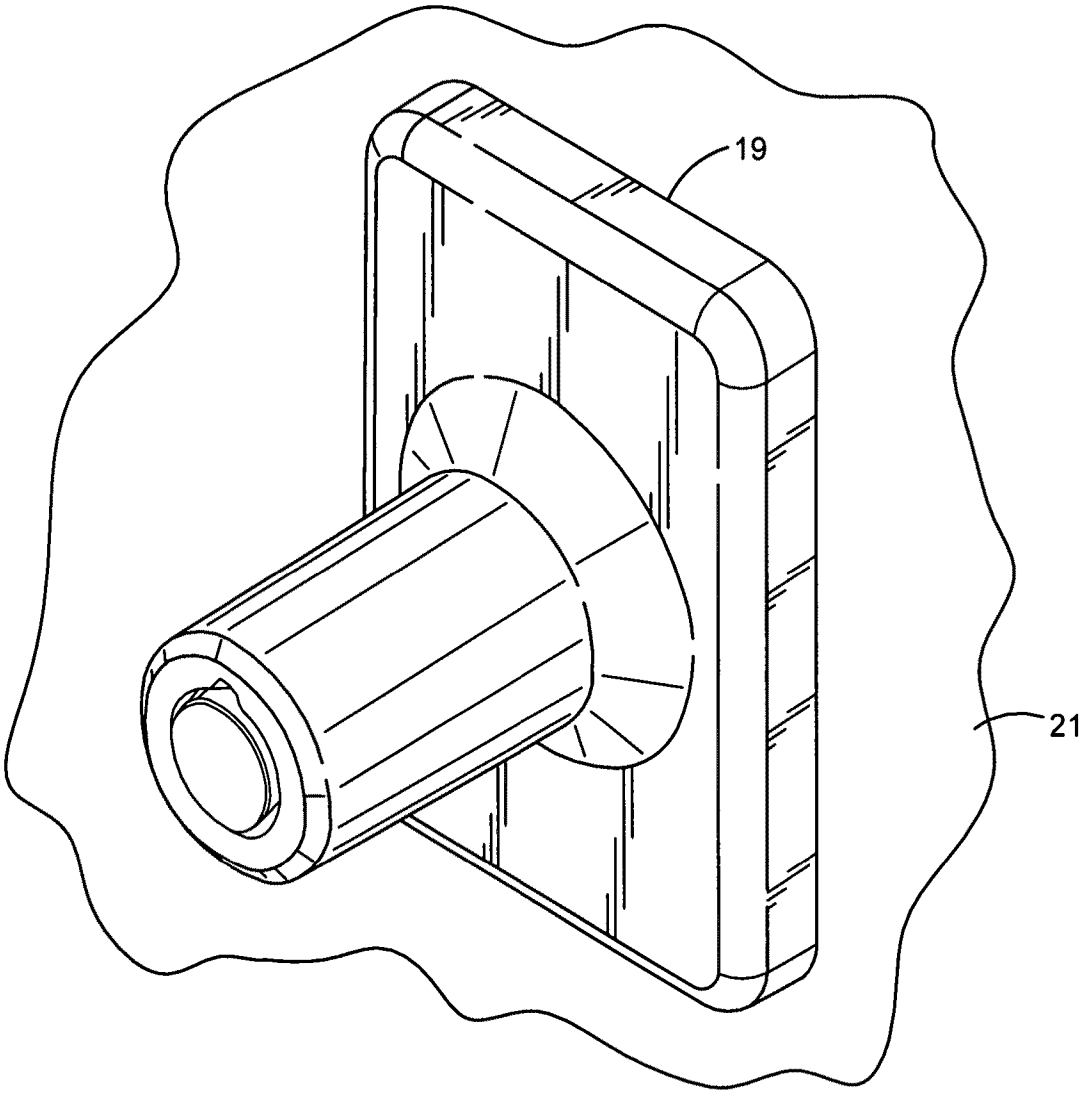
FIG. 7 is an enlarged perspective view of a standoff affixed to a mounting surface for mounting the acoustic material frame assembly to the mounting surface.

As shown in FIG. 7, standoffs 19, such as two-inch standoffs, that can be affixed to a mounting surface 21 are used to support and allow frame assembly 10 to stand-off or float from mounting surface 21. The gap between frame assembly 10 and mounting surface 21 allows sound waves to pass through acoustic material 12, bounce off surface 21 and enter acoustic material 12 a second time substantially preventing the sound wave from re-entering the desired area. Standoffs 19 are affixed to mounting surface 21 by using Velcro fasteners or other hook and loop fasteners, snaps, magnets, slip-notches, clips or similar methods. An attaching apparatus, such as a magnet, hook and loop fastener, double-sided tape and the like can also be used to mount frame assembly 10 directly on mounting surface 21.

Figure 4:
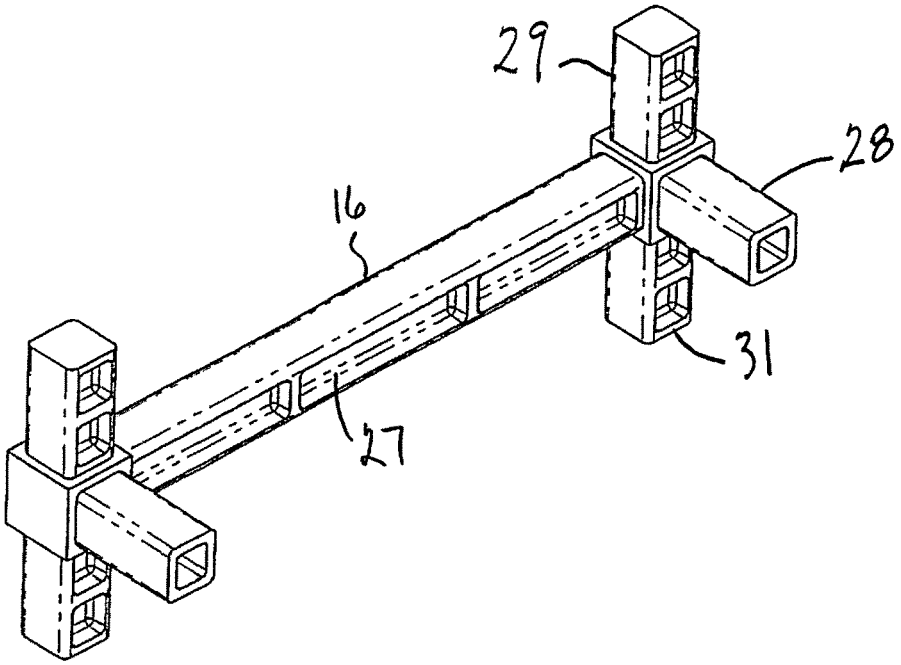
FIG. 4 is a perspective view of the T-connector of the frame of the acoustic material frame assembly of FIG. 1.
Figure 5:
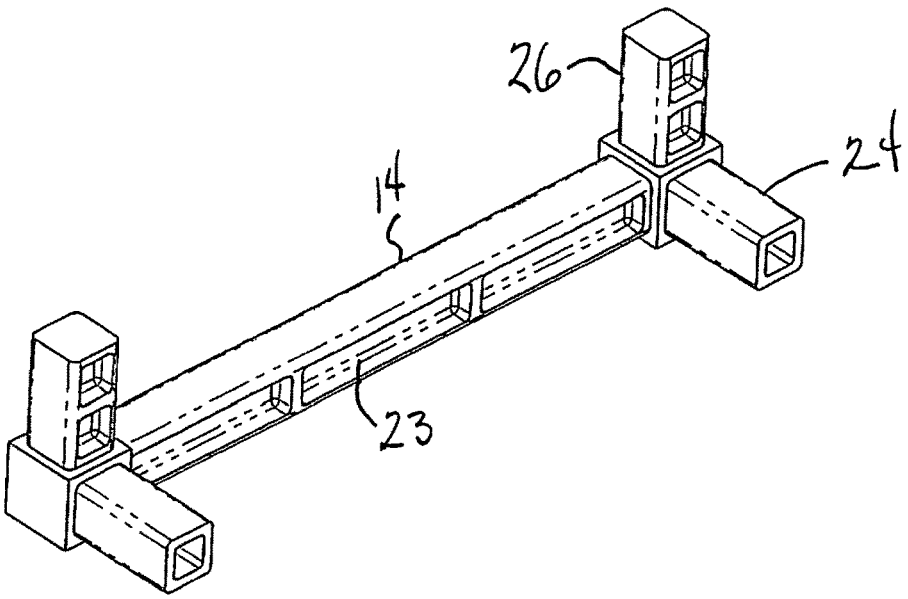
FIG. 5 is a perspective view of the corner connector of the frame of the acoustic material frame assembly of FIG. 1.
Figure 10:
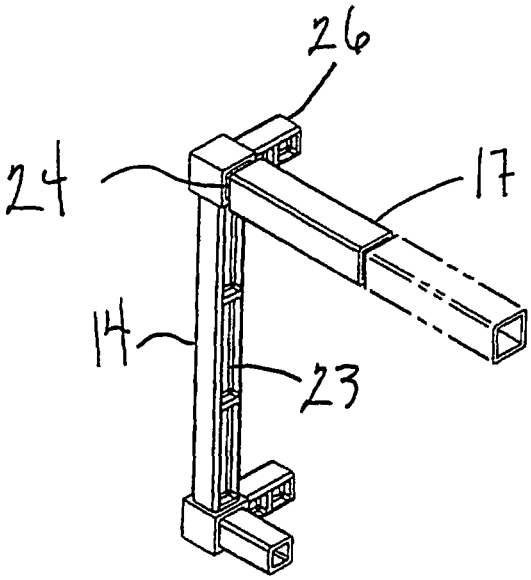
FIG. 10 is a perspective view of the frame tubing press-fit onto a corner connector trunk.

As shown in FIGS. 4 and 5, corner connectors 14 are four-inch corner connectors to accommodate the desired depth of the acoustic material used and the T-connectors 16. The depth of frame 11 is determined by selecting four-inch connectors 14 and 16 or other sized connectors depending on the depth of the acoustic material and level of sonic absorption desired. Corner connectors 14 have a transverse member 23 with trunks 24 and 26 projecting outwardly at right angles from the end of transverse member 23. Trunks 24 and 26 telescope and press-fit into the end of tubing 17 as seen in FIG. 10. Similarly, T-connectors 16 have a transverse member 27 with trunks 28, 29 and 31 projecting outwardly in opposing directions and right angles from the end of transverse member 27. Trunks 28, 29 and 31 are adapted to telescope into the end of tubing 17 with a press-fit to connect tubing 17 with T-connectors 16. Trunks 24, 26, 28, 29 and 31 are shaped complimentary to the shape of tubing 17, such as rectangular shaped and the like, to facilitate press fitting.

Frame assembly 10 can be mounted, suspended, hung or installed on a wall, ceiling or other surface, or let to free-stand in the desired area. Frame assembly 10 is mounted to a flat target surface 21 with fasteners such as Velcro or other hook and loop fasteners, clips, magnets, double-sided tape, hooks, screws or other methods looked on a selected area on the back of frame assembly 10 for flush and even mounting. Also mounting devices, such as standoffs 19, can be applied to mounting surface 21 or other target surface that frame assembly 10 connects via Velcro or other hook and loop fastener, clips, magnets, double-sided tape, or other methods. This allows for the entire frame assembly 10 to stand-off away and be spaced a fixed distance from the targeted mounting surface, thus allowing frame assembly 10 to capture additional sound waves.

The method of making frame assembly 10 includes assembling frame 11 starting with press-fitting or otherwise inserting tubing 17 into corner connectors 14 to form corner assemblies. The remaining tubing 17 is press-fit into T-connectors 16 to form T-connector assemblies. The corner assemblies are then connected to the T-connector assemblies to complete frame 11. Acoustic material 12 is then slid or inserted into open end 18 of frame 11. Fabric slipcover 13 is then placed over the top of frame 11 and pulled down to enclose frame 11. Fabric slipcover 13 is pulled tight and secured in the back of frame 11 with a fastener. The entire frame 11 with encased acoustic material 12 is covered with fitted fabric slipcover 13 which is adapted to be easily pulled over to completely cover frame 11, and secured using a drawstring, ties, zippers, hook and loop, snaps or other like fasteners. Once frame 11 and acoustic material 12 are covered, the frame assembly 10 is ready for installation and use.

Depending on the shape of frame assembly 10 desired, the corner assemblies are assembled by using one of the four-way corner connectors 14 and inserting or press-fitting the appropriate length tubing 17 onto corner connector 14. The remaining corner assemblies are assembled in a similar manner. The mid section T-connector assemblies of frame 11 are assembled by using the six-way T-connectors 16 and inserting or press-fitting the appropriate length plastic tubing 17 onto the T-connectors 16. Acoustic material 12 is then placed into open end 18 of frame 11 and contained within frame 11. Frame 11 with encased acoustic material 12 is covered with fabric slipcover 13 to complete the assembly of frame assembly 10. The open end of slipcover 13 is placed over the open end of the frame 11 while making sure slipcover 13 is properly oriented with the front and back of frame 11. The fabric of slipcover 13 has a slight stretch character that allows slipcover 13 to easily fit over frame 11. Slipcover 13 is then pulled down evenly to the bottom of frame 11. Slipcover 13 can have a securing flap which can be pulled towards the back of frame 11 and secured with a Velcro fastener or other hook and loop fastener, draw-string tie, zipper, snaps, magnets, or other similar methods.

Standoffs 19, such as four 2-inch mounting brackets, can be attached or affixed to target mounting surface 21 to ensure maximum performance of frame assembly 10. Fastening material, such as a magnet, hook and loop fastener, double-sided tape or other fasteners, can be located on the back of the acoustic frame to align with the standoff mounting brackets and affixed thereto. Frame 11 is preferably constructed and manufactured using a plastic or thermoplastic and can be sourced using recycled or biodegradable plastic. Corner connectors 14, T-connectors 16 and tubing 17 of frame 11 are easily manufactured in such a way as to apply industry standard equipment such as thermoplastic injection molding, CNC milling, additive 3D printing or other similar or related manufacturing equipment.

Figure 11:
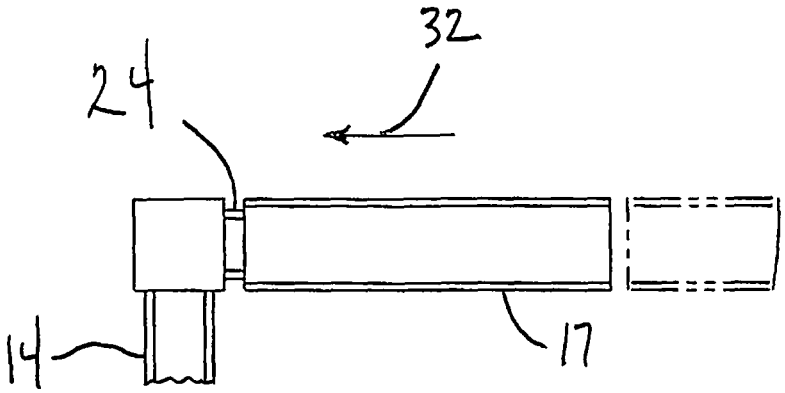
FIG. 11 is a foreshortened top view of the frame tubing being press-fit onto a corner connector trunk.

Tubes 17 and corner connectors 14 are assembled first by aligning and press-fitting each tube 17 onto corresponding trunks 24 and 26 on corner connector 14, as shown by arrow 32 in FIG. 11. T-connectors 16 and tubing 17 are then press-fit together and connected to the previously assembled corner sections to complete the device. T-connectors 16, corner connectors 14, and connector trunks 24, 26, 28, 29 and 31 can be labeled with numbers that correspond to each precisely cut square tubing 17 to facilitate quick and easy assembly.

Figure 8:
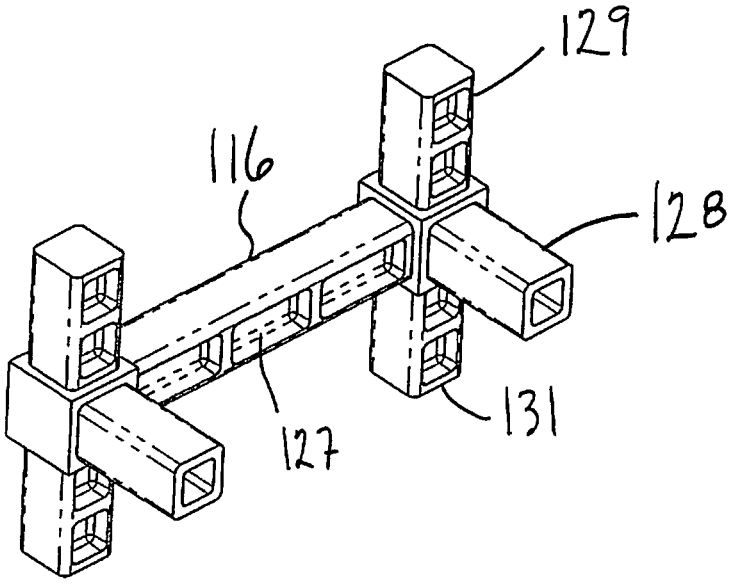
FIG. 8 is a modification of the T-connector of the frame.
Figure 9:
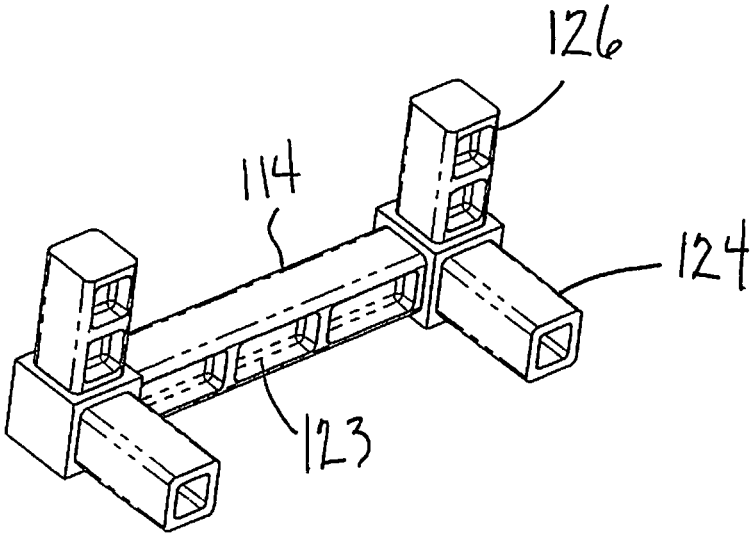
FIG. 9 is a modification of the corner connector of the frame.

As shown in FIGS. 8 and 9, corner connectors 114 are two-inch corner connectors to accommodate the desired depth of acoustic material 12 used and two-inch T-connectors 116. The depth of frame 11 is determined by selecting two-inch connectors 114 and 116 or other sized connectors depending on the depth of the acoustic material and level of sonic absorption required. Corner connectors 114 have a transverse member 123 with trunks 124 and 126 projecting outwardly at right angles from the end of transverse member 123. T-connectors 116 have a transverse member 127 with trunks 128, 129 and 131 projecting outwardly in opposing directions and right angles from the end of transverse member 127. Trunks 124, 126, 128, 129 and 131 telescope into the end of tubing 17 with a press-fit to connect tubing 17 with connectors 114 and 116 to assemble frame 11 to have a two-inch depth. Trunks 124, 126, 128, 129 and 131 are shaped complimentary to the shape of tubing 17, such as rectangular shaped and the like, to facilitate press fitting.

The acoustic material frame illustrated and described includes several embodiments of the invention. Variations and modifications of the acoustic material frame and acoustic frame materials can be made by a person skilled in the art without departing from the invention.

The invention claimed is:

1. An acoustic material frame assembly comprising:

a plastic tube frame, the plastic tube frame having four-way corner connectors and six-way T-connectors joined to the four-way corner connectors with a plurality of plastic tubes to define a plastic tube frame member, the plastic tube frame member having an open interior, a front, a back and sides, each four-way corner connector having a first transverse member, first trunks projecting outwardly at right angles from each end of the first transverse member, the first trunks pressed fit into the plastic tubes, each six-way T-connector having a second transverse member, second trunks projecting outwardly at right angles from each end of the second transverse member, the second trunks pressed fit into the plastic tubes opposite from a corresponding four-way corner connector, the plastic tube frame member enclosing acoustic absorption material, the plastic tube frame member having an open end in communication with the open interior to allow the acoustic absorption material to be inserted through the open end into the open interior of the plastic tube frame member, the acoustic absorption material adapted to absorb sound emitting from a surrounding environment adjacent the plastic tube frame member, the acoustic absorption material having a plurality of insulation particles, an acoustically transparent fabric slipcover conducive to penetrable sound waves, and the acoustically transparent fabric slipcover having a fastener to hold the acoustically transparent fabric slipcover around the front, the back and the sides of the plastic tube frame member, the acoustically transparent fabric slipcover fully covering the open end, the front, the back and the sides of the plastic tube frame member whereby sound waves are allowed to penetrate and be absorbed by the acoustic absorption material located in the open interior of the plastic tube frame member and the plurality of insulation particles from the acoustic absorption material are prevented from escaping into the surrounding environment, and standoffs adapted to be affixed to an upright mounting surface, the standoffs engaging the back of the plastic tube frame member to maintain a fixed transverse distance between the plastic tube frame member and the upright mounting surface.

2. The acoustic material frame assembly of claim 1 wherein:

the plastic tubes are biodegradable square shaped plastic thermoplastic tubes.

3. A method for acoustic absorption comprising:

providing a plastic tube frame, the plastic tube frame having an open end, and open interior, a front, a back and sides, inserting acoustic absorption material through the open end and into the open interior of the plastic tube frame, the acoustic absorption material adapted to absorb sound in an environment surrounding the plastic tube frame, the plastic tube frame having four-way corner connectors and six-way T-connectors and a plurality of plastic tubes pressed fit into the four-way corner connectors and the six-way T-connectors to join the four-way corner connectors to the six-way T-connectors, covering the plastic tube frame and the acoustic absorption material located in the open interior of the plastic tube frame with an acoustically transparent fabric slipcover whereby sound waves are allowed to penetrate and be absorbed by the acoustic absorption material, securing the acoustically transparent fabric slipcover around the open end, the front, the back and the sides of the plastic tube frame to fully cover the plastic tube frame and the acoustic absorption material located in the open interior of the plastic tube frame, installing the plastic tube frame and the acoustic absorption material located in the open interior of the plastic tube frame encased with the acoustically transparent fabric slipcover in the environment to absorb sound in the environment, and providing standoffs adapted to be affixed to an upright mounting surface, the standoffs engaging the back of the plastic tube frame to maintain a fixed transverse distance between the plastic tube frame and the upright mounting surface.

4. The method of claim 3 including:

assembling the plastic tube frame to have a depth of between two and four inches.

5. The method of claim 3 wherein:

the plastic tubes are biodegradable square shaped plastic thermoplastic tubes.

6. The method of claim 3 wherein:

the four-way corner connectors each having a transverse member and trunks projecting outwardly at right angles from ends of the transverse member, the trunks adapted to telescope and press-fit into ends of the plastic tubes.

7. The method of claim 3 wherein:

the six-way T-connectors each having a transverse member and trunks projecting outwardly in opposing directions and at right angles from ends of the transverse member, the trunks adapted to telescope and press-fit into ends of the plastic tubes.

8. The method of claim 3 including:

preventing insulation particles located in the acoustic absorption material from escaping into the environment.

9. The method of claim 3 including:

mounting the plastic tube frame on an upright mounting surface.

10. The method of claim 3 including:

maintaining a fixed transverse distance between the plastic tube frame and an upright mounting surface.

* * * * *